US005576805A

United States Patent [19]

Ishihara et al.

[11] Patent Number: 5,576,805

[45] Date of Patent: Nov. 19, 1996

[54] CONTACT CHARGING MEMBER FOR CHARGING A PHOTOSENSITIVE DRUM HAVING IMPROVED DURABILITY AND A METHOD FOR MAKING THE SAME

[75] Inventors: Yuzi Ishihara; Kiyoshi Mizoe, both of Kawasaki; Tsunenori Ashibe, Yokohama, all of Japan

[73] Assignee: Canon Kabushiki Kaisha, Tokyo, Japan

[21] Appl. No.: 404,912

[22] Filed: Mar. 16, 1995

[30] Foreign Application Priority Data

| | | | |
|---|---|---|---|
| Mar. 16, 1994 | [JP] | Japan | 6-071534 |
| Dec. 29, 1994 | [JP] | Japan | 6-340063 |
| Mar. 7, 1995 | [JP] | Japan | 7-047227 |

[51] Int. Cl.[6] ..... G03G 15/02

[52] U.S. Cl. ..... 355/219; 361/225

[58] Field of Search ..... 355/219; 361/225

[56] References Cited

U.S. PATENT DOCUMENTS

| | | | |
|---|---|---|---|
| 4,360,262 | 11/1982 | Genthe | 355/219 |
| 4,379,630 | 4/1983 | Suzuki | 361/225 |
| 5,126,913 | 6/1992 | Araya et al. | 361/225 |
| 5,140,371 | 8/1992 | Ishihara et al. | 355/219 |
| 5,363,176 | 11/1994 | Ishihara et al. | 355/219 |

FOREIGN PATENT DOCUMENTS

| | | | |
|---|---|---|---|
| 63-149669 | 6/1988 | Japan . | |
| 3-233473 | 10/1991 | Japan | 355/219 |
| 3-246566 | 11/1991 | Japan . | |
| 4-25870 | 1/1992 | Japan | 355/219 |
| 4-42175 | 2/1992 | Japan | 355/219 |
| 4-157483 | 5/1992 | Japan | 355/219 |

*Primary Examiner*—Joan H. Pendegrass
*Attorney, Agent, or Firm*—Fitzpatrick, Cella, Harper & Scinto

[57] ABSTRACT

A charging member contactable to a member to be charged to electrically charge it, the improvement residing in that a microhardness of an end region, with respect to a longitudinal direction, of the charging member is larger than that in a central region of the charging member.

57 Claims, 8 Drawing Sheets

CONTACT CHARGING MEMBER FOR CHARGING A PHOTOSENSITIVE DRUM HAVING IMPROVED DURABILITY AND A METHOD FOR MAKING THE SAME

FIELD OF THE INVENTION AND RELATED ART

The present invention relates to a charging member and a charging device for charging a member to be charged, usable with a copying machine and a laser beam printer or the like.

Heretofore, as to the charging device for the image forming apparatus such as the copying machine, a corona charging device has been widely used.

However, recently, a contact charging device for charging the member to be charged by press-contacting the charging member supplied with a voltage to the member to be charged at a constant pressure, has been placed into practice.

The contact charging device, as compared with the corona charging device, has the advantageous effects, for example, that ozone is hardly produced, and a large voltage source is not necessary.

The contact charging device is provided with a charging roller in contact with a photosensitive member as the the member to be charged as disclosed in, for example, U.S. Pat. No. 5,126,913, and the charging roller includes a base supplied with a voltage, a electroconductive elastic layer on the base and the resistance layer on the electroconductive elastic layer.

The abovedescribed contact charging type mainly uses the discharge at the gap between the charging member and the member to be charged, and therefore, when the member to be charged in the form of photosensitive member has a thin film thickness portion, the resistance of the portion is low, and therefore, the discharge tends to be concentred thereonto.

As a result, the surface of the photosensitive member is deteriorated, and the local wearing is produced.

The phenomenon tends to occur at the end portio of (with respect to the generating line direction of the organic photosensitive member) particularly when the use is made with organic photosensitive member as the member to be charged.

The reason is as follows.

The organic photosensitive member is uaually produced using the coating method called dipping, and therefore, the film thichness of the first dipped portion at one side of the organic photosensitive member is decreased.

In this manner, when the wearing of the organic photosensitive member is the produced, the image defect such as leakage and/or fog is produced on the image.

In addition, when the printer speed is increased, a amount of current flowing to the charging member has to be increased accordingly, and therefore, the phenomenon, is promotionned.

As disclosed in Japanese Laid Open Patent Application No. HEI-3246566 and Japanese Laid Open Patent Application No HEI-4157483, it is known that wearing of the photosensitive member is prevented, by increasing the resistance at the non-image area and/or end portion of the charging member corresponging to the end portio of the photosensitive member.

However, even in the abovedescribed prior art, there are problems of productivity reduction and end portion wearing of the charging member.

When the end portion of the charging member is worn, the charging action becomes non-stable by the change of the contact state between the charging member and photosensitive member, and the current leakage occurs to the photosensitive member from the end portion of the charging member, in some cases.

SUMMARY OF THE INVENTION

A principal object of the present invention is to provide a charging member and a charging device wherein wearing of the charging member at the end portion (in the longitudinal direction) of the charging member is prevented.

Another object of the present invention is to provide a charging member and a charging device wherein the leakage due to wearing of the member to be charged is prevented.

A further object of the present invention is to provide a charging member and a charging devices wherein the productivity of the charging member is improved.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

DESCRIPTION OF THE PREFERRED EMBODIMENTS (1) an exmaple of image forming apparatus FIG. 1 shows a schematic arrangement of an example of a image forming apparatus employmenting the contact charging device as the charging means for the image bearing member.

Figure 1:
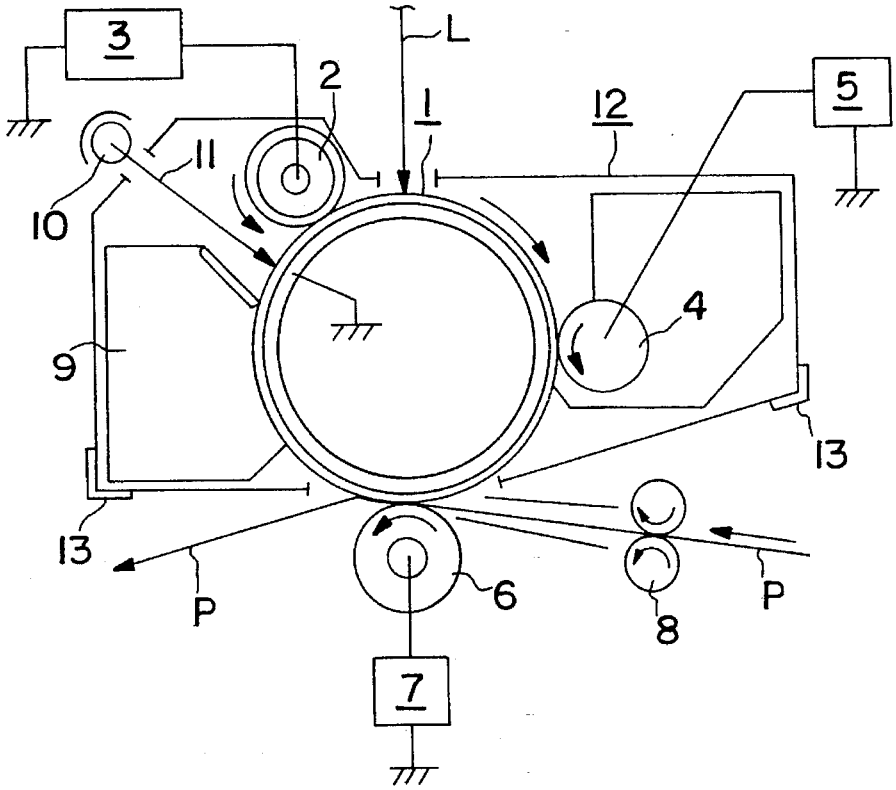
FIG. 1 is a schematic side view showing an example of a image forming apparatus using a charging member according to the present invention.

The exemplary image forming apparatus is a tranfer type copying machine, or a laser beam printer of the electrophotographic process type.

Reference numeral 1 designates a drum type photosensitive member as a image bearing member (member to be charged), and is rotated at a predetermined peripheral speed (process speed) in the clockwise direction indicated by the arrow.

Reference numeral 2 designates a charging member of a roller configuration as the charging member, which will hereinafter also be called "charging roller", and in the case of this example it is rotated by the rotation of the photosensitive member 1.

Designated by 3 is a charging bias application voltage source for the charging roller 2, and it supplies to the charging roller 2 a DC voltage of the predetermined polarity and the potential (DC application type), or a oscillating voltage in the form of a AC voltage biased with DC voltage (AC application type), so that the peripheral surface of the rotating photosensitive member 1 is subjected to primary charging process to the predetermined polarity and the potential.

The exposure L to the intended image information is effecteded by a unshown exposure means (slit imaging and projection means, laser beam scanning exposure means or the like), so that a electrostatic latent image is formed on the surface of the photosensitive member 1.

The electrostatic latent image is developed into a toner image by a developing device 4.

Designated by 5 is a developing bias application voltage source.

The toner image on the rotating photosensitive member 1 is tranfered onto a recording material P fed at a predetermined timing by registration roller pair 8 after being separated and fed out from a unshown sheet feeding portion to the tranfer portion as the press-contact nip portion between a tranfer roller 6 and the photosensitive member 1.

Designated by 7 is a tranfer bias application voltage source for the tranfer roller 6.

The recording material P having been subjected to the image tranfer of the toner image at tranfer portion, is separeted from the photosensitive member 1, and is introduced to a unshown fixing device, and then is subjected to the toner image fixing process, and thereafter, is discharged to a discharge portion.

Or, in the case of a superimposing mode, or a duplex mode, the recording material P is fed to the tranfer portion by an unshown re-circulation feed mechanism, and is subjected to the tranfer of the toner image onto the same surface or the second surface.

Then, it is is separeted from the photosensitive member 1, and is introduced to the fixing device where it is subjected to the fixing process, and is discharged to the discharge portion.

The photosensitive member 1 after the toner image tranfer to the recording material P, is cleaned so that the removal of the remaining deposition material such as the residual toner is carried out by a cleaner 9, and in addition, is subjected to discharging exposure 11 by a eraser lamp 10 so as to be subjected to the image formation repeatedly.

The exemplary image forming apparatus is a process cartridge mounting-and-demounting type. The exemplary device is structured as a process cartridge 12 which is a detachably mountable relative to the the main assembly of the image forming apparatus and which contains as a unit 4 process means i.e., the photosensitive member 1, the charging roller 2, the developing device 4 and the cleaner 9 the process cartridge 12 may include at least the photosensitive member 1 and the charging roller 2.

Designated by 13, 13 is the main assembly of cartridge mounting guiding members.

By being mounted to a predetermined positoin of the main assembly, the process cartridge 12 is electrically and mechanically connected with the main assembly.

The photosensitive member 1 as the member to be charged is provided with a organic photosensitive layer on a electroconductive base member, for example, and if necessary, a primer layer having a barrier function and a bonding function may be provided between them.

Such an organic photosensitive member has a high safty property, a proper charging property, a high productivity, and is inexpensive.

Because of these features, it is frequently used as the image bearing member for the image forming apparatus.

However, because a resin material is generally used as a binder, it is easily influenced by the event such as a molecular weight decrease due to the electric discharge.

However, by use of the charging member of the present invention, a high durability is possible while maintainig the feature of the organic photosensitive member.

As to the electroconductive base member of the image bearing member as the member to be charged the following can be used.

A. metal such as aluminium, aluminium alloy, stainless steel, copper.

B. non-electroconductive member of glass, resin material, paper or the like, and the electroconductive member of paragraph A having a surface with a thin film laminated, or evaporationned with metal such as aluminium, palladium, rhodium, gold, white gold or the like.

C. non-electroconductive member of glass, resin material, paper or the like or the electroconductive support member of parajj having a surface with a layer applied, or evaporationned with a electroconductive material such as indium oxide, electroconductive polymeric material or tin oxide.

As normal materials of primer layer formation, there are polyvinyl alccohol, polyethylene oxide, ethyl cellulose, methyl cellulose, casein, polyamide, glue, gelatine or the like.

The organic photosensitive layer comprises a charge generating layer and a charge transfer layer, and for the purpose of charge injection control, for example, a protection layer may be provided on the photosensitive layer.

The charge generating layer can be formed by dispersing a proper charge generating matrial in the binder and applying it on the electroconductive base member.

The thin film can also be formed on the electroconductive base member by dry type method such as CVD, evaporation or sputtering.

As the charge generating matrial, the following materials are raised, for example.

These charge generating mat rials may be used independently, or not less than two kinds can be combined.

A. azo-pigment such as mono azo-, bisazo, trisazo.

B. indigo pigment such as indigo, thioindigo.

C. phthalocyanine pigment such as metal-phthalocyanine, metal-free-phthalocyanine.

D. perilenic pigment such as perilenic anhydride, perilenic imide.

E. polycyclic quinone pigment such as anthraquinone, hydroquinone.

F. squarilium color element.

G. pyrylium salt, thiopyrylium salt.

H. triphenylmethane color element.

In addition, as to the binder, it can be selected from wide range binder resin materials, for example, polycarbonate resin material, polyester resin material, poly acrylate resin material, butyral resin material, polystylene resin material, polyvinyl-acetal resin material, diallyl phthalate resin material, acrylic, vinyl acetate resin material, phenolic resin, silicone resin material, polysulfon resin material, stylene butadiene copolymer resin material, alkyd resin material, epoxy resin material, urea resin material, vinyl chloride vinyl acetate copolymer resin material or the like.

However, the materials are not limited to these materials.

Alternatively, they may be used independently, or one kind, or not less than two kinds may be mixtured as the copolymer resin material.

The resin material content in the charge generating layer is preferably not more than 80% by wt, further preferably not more than 40% by wt.

In addition, the film thichness of the charge generating layer is preferably not more than 5 microns, particularly 0.01 microns–2 microns.

The charge generating layer may be added with various sensitization material.

As for the charge generating layer, paint in the form of a solvent mainly dissolving therein the binder resin and the charge transfer material, is applied and dryed.

As to the charge transfer substance, the various triarylamine material, hydrazone material, stilbene material, pyrazoline material, oxazole material, thiazole material, triarylmetane material or the like, are usable.

As to the binder resin, the above-described materials can be used.

For the application of the organic photosensitive layer materials, any conventional dipping method, spray coating method, spinner coating method, bead coating method, blade coating method, beam coating method, roll coating method or the like can be used.

Using such a material, the organic photosensitive member is prepared, and is used for the process cartridge or the like.

(3) charging member.

Recently, due to the demands for stability of the quality over a long period, running cost reduction, and/or reuse as the countermeasure against environmental problems with respect to disposed materials and/or natural resource saving, or the like, the high durability of the charging member per se is now desired.

The method increasing resistance of the non-image area and/or end portion of the charging member, as in the abovedescribed example, involves drawbacks like the following.

In the contact type charging device, the charging member is press-contacted with the constant pressure, to the member to be charged in the form of the organic photosensitive member, but when the organic photosensitive member is rotated in this state, the frictional force is occured between the organic photosensitive member.

Therefore, the wearing of the surface of the charging member which is soft as compared with the surface of the organic photosensitive member occurs.

Normally, the charging member is supported and presed at the opposite ends, and therefore, the load or pressure increases toward the end portions, and therefore, an amount of wearing of the surface increases toward the opposite end portions of the charging member.

In addition, since the voltage is applied to the charging member, the phenomenon is promoted due to the influence of the electric energization.

Additionally, if the friction coefficient is larger toward the opposite end portions, the tendency is more remarkable.

When the wearing is increased on the surface of charging member at the end portion in this manner, the following problems arise in some cases.

In the charging member having the structure including a coated layer on the electroconductive elastic layer, when the surface of charging member is worn, the film thickness of the coated layer is decreased, and therefore, the function of blocking the transition of the substance seeped out of the electroconductive elastic layer toward the surface of the charging member is deteriored.

Therefore, the substance tends to be depositted on the surface of the organic photosensitive member, and in some cases, the deterioration of the surface of the organic photosensitive member occurs with the possible result of the deterioration of the image.

In addition, in the case that the impedance of the electroconductive elastic layer is low as compared with the impedance of the coated layer, the electric field concentration easily occurs at the portion having the thinned coated layer, even to such an extent that the dielectric breakdown is occured in some cases.

In this case, not only the image quality degrades, the lifetime of the charging member also comes to the end.

In order to solve the abovedescribed problem, to permit uniform charging of the surface of the member to be charged and, to meet the demand for the high durability and the high speed, a microhardness of the surface of the end portio of the charging member (in the longitudinal direction) is preferably higher than the microhardness in a middle portion of the charging member.

In addition, when the use is made with photosensitive member as the member to be charged, the microhardness of the charging member corresponding to the non-image area of the photosensitive member is desirably larger than the microhardness of the charging member corresponding to the image area of the photosensitive member.

By dong so, the wearing at the end portio of the surface of the charging member can be prevented.

Therefore, instability of charging due to the change of the contact state between the photosensitive member and the charging member can be prevented.

In such a case, the microhardness at the end portion region of the charging member is desirably higher than the microhardness at the middle portion by not less than 4°, and further preferably, by not less than 6°.

In the case of the difference less than 4°, the effect of preventing the wearing of the surface of the charging member is insufficient.

In addition, the microhardness at the end portion region of the charging member is not more than 90° further preferably not more than 85°.

If it is higher, the toner fusing tends to to occur in some cases.

In addition, the effect of preventing the leakage due to end portion wearing of the charging member is significant, particularly when the microhardness is selected as described hereinbefore, and the charging member is provided with at least electroconductive elastic layer, and one or more coated layer thereon.

As to the method for increasing the microhardness at the charging member end portion region beyond the microhardness at the middle portion of charging member, it will suffice if the microhardness of the end portion region of the electroconductive elastic layer and/or the coated layer is increased as compared with that of the middle portion.

Figure 8:
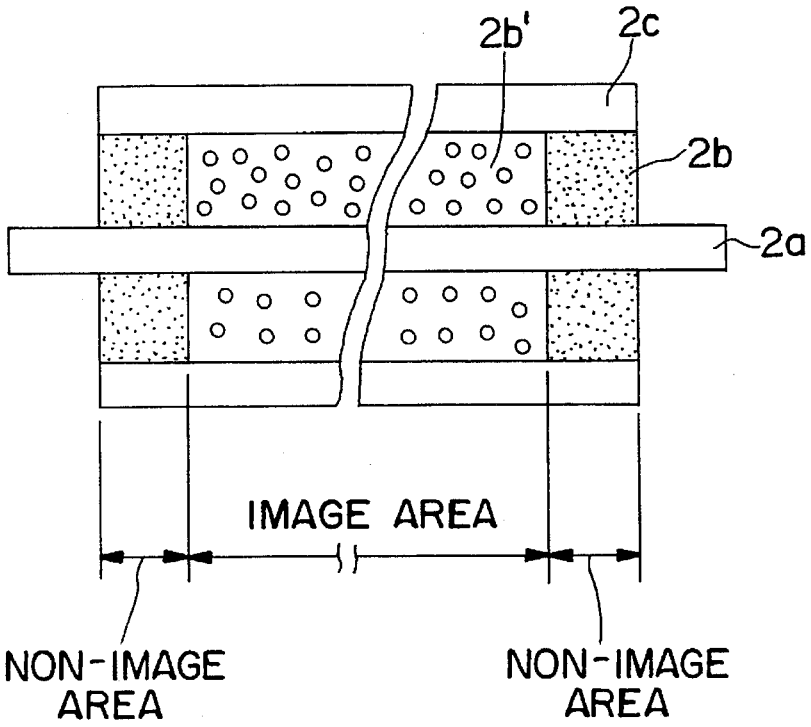

In order to increase the microhardness of the end portion region of the electroconductive elastic layer as compared with the middle portion, as shown in FIG. 8, for example, a solid material 2*b* is used for the charging member in the region corresponding to the non-image forming region of the photosensitive member, and a sponge material 2*b*' is used for the image forming region of the photosensitive member.

According to this example, the material having a high microhardness is used for the non-image forming region.

In another alternative, the microhardness at the non-image forming region is increased by changing the vulcanization condition.

On the electroconductive elastic layer prepared in this manner, the coating layer may be provided, if necessary.

In addition, the maximum diameter of the charging member at the end portion region is preferably not less than 1.0010 times and less than 1.5000 times of the maximum diameter of the charging member of the middle portion.

In order to increase the microhardness of the non-image forming region portion of the coated layer as compared with that of the image forming region portion, as shown in FIG. 2, FIG. 3, FIG. 4, FIG. 5, FIG. 6, FIG. 7, FIG. 11, FIG. 12, FIG. 13, FIG. 15, for example, the material having a high the microhardness as compared with the image forming region is used for the non-image forming region.

Figure 9:
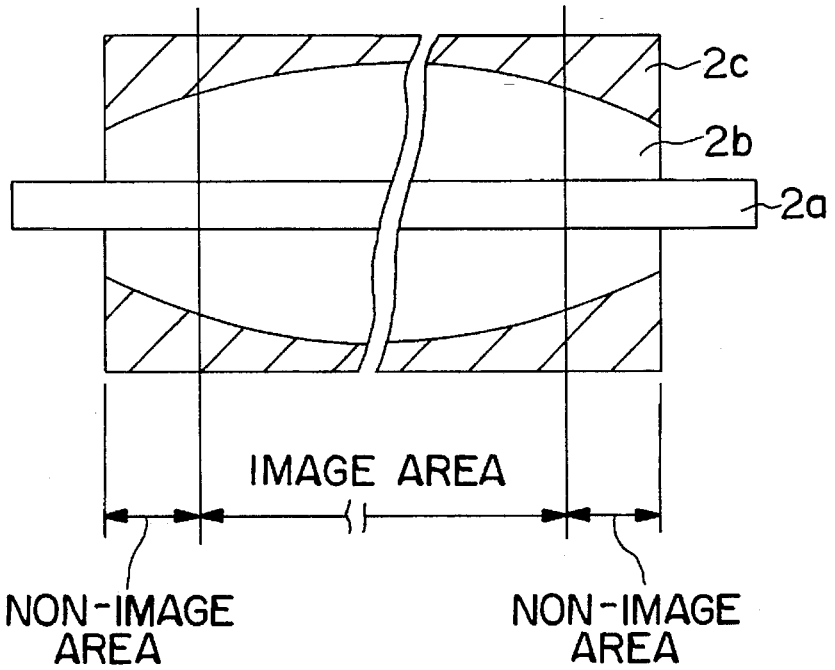
Figure 10:
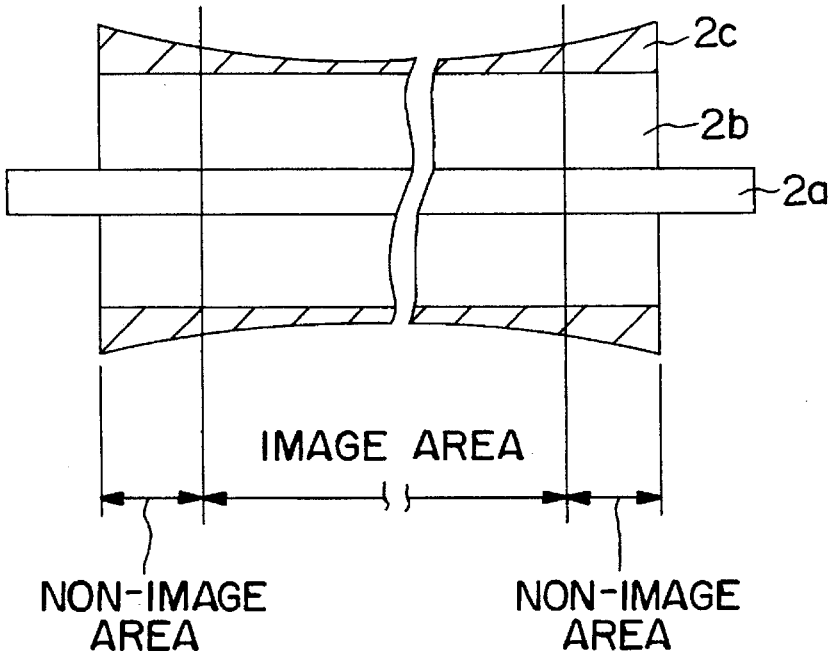
Figure 11:
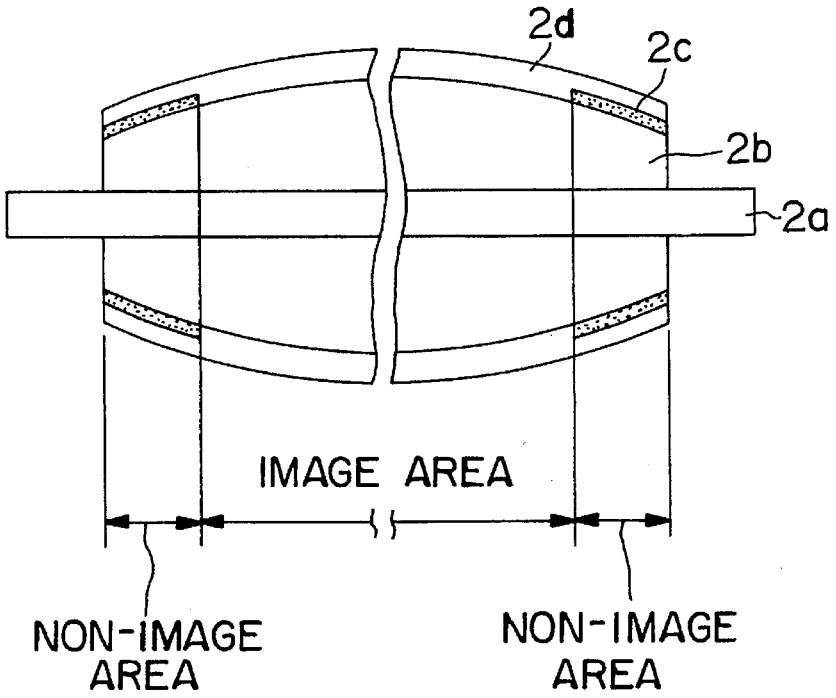
Figure 14:
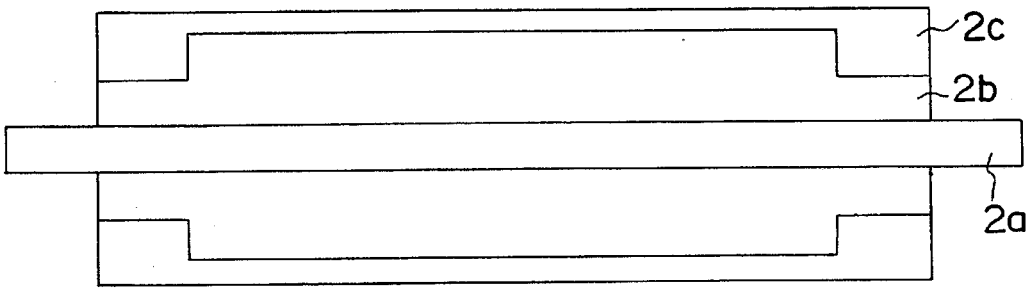
Figure 15:
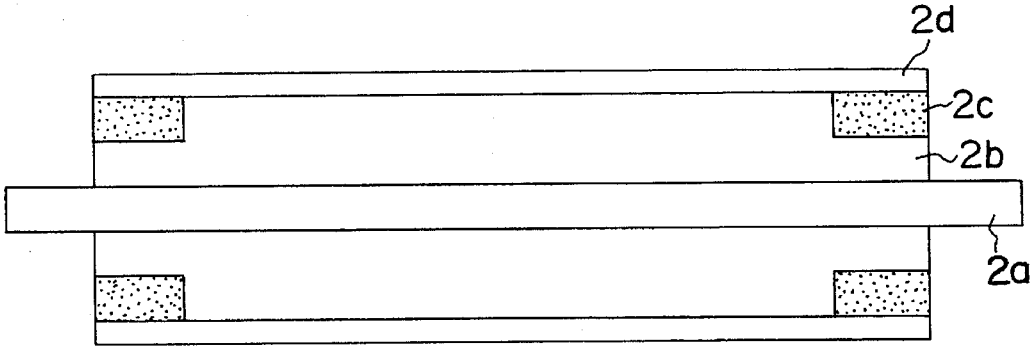

As for another means, as shown in FIG. 14 FIG. 9, FIG. 10 and, for example, the film thichness of the coated layer of the non-image forming region is increased beyond the film thickness of the coated layer of the image forming region.

The former and the latter may be combined.

In these cases, the coated layer may be of one, two or more layer structure.

As to the means forming the coated layer on the electroconductive elastic layer, there are, for example, coating means such as dip coating, roll coating, spray coating and/or means for coating it with the tube-like material molded beforehand, or the like. However, these means are not limiting.

Figure 2:
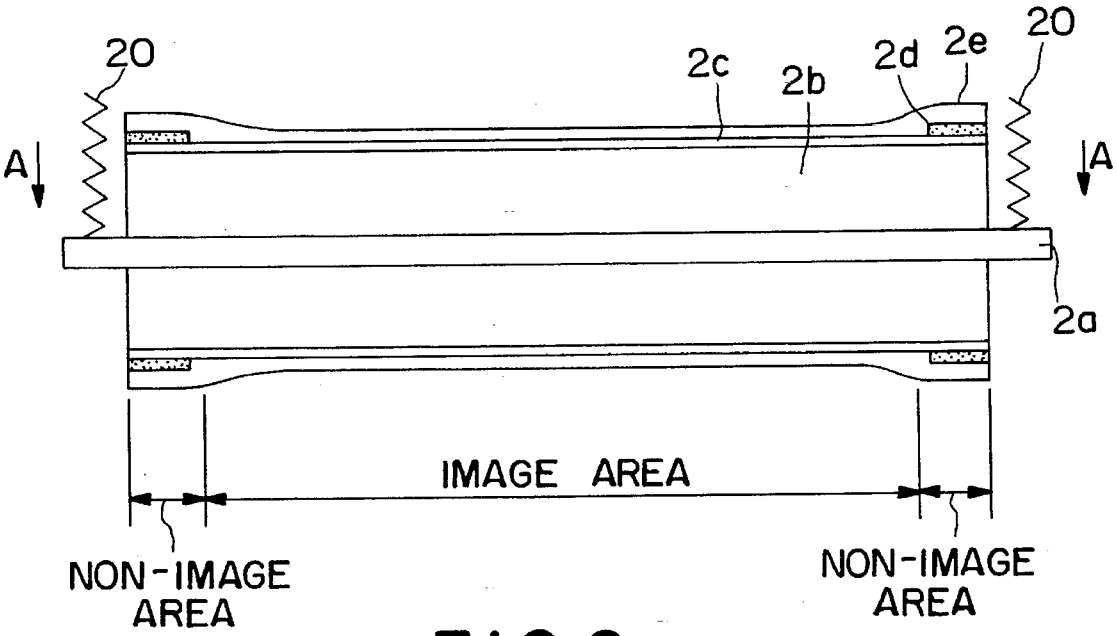
FIGS. 2–18 are sectional front views showing embodiments of the charging member.
Figure 3:
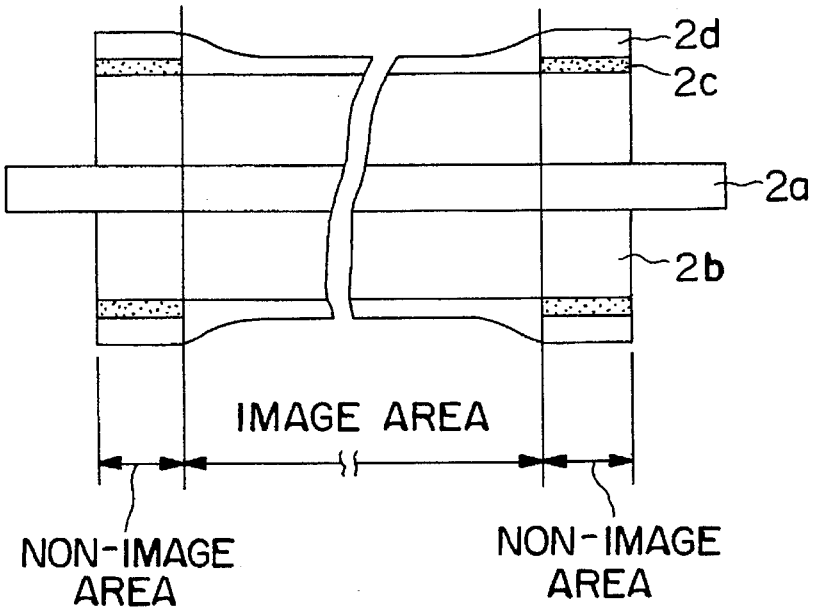
Figure 4:
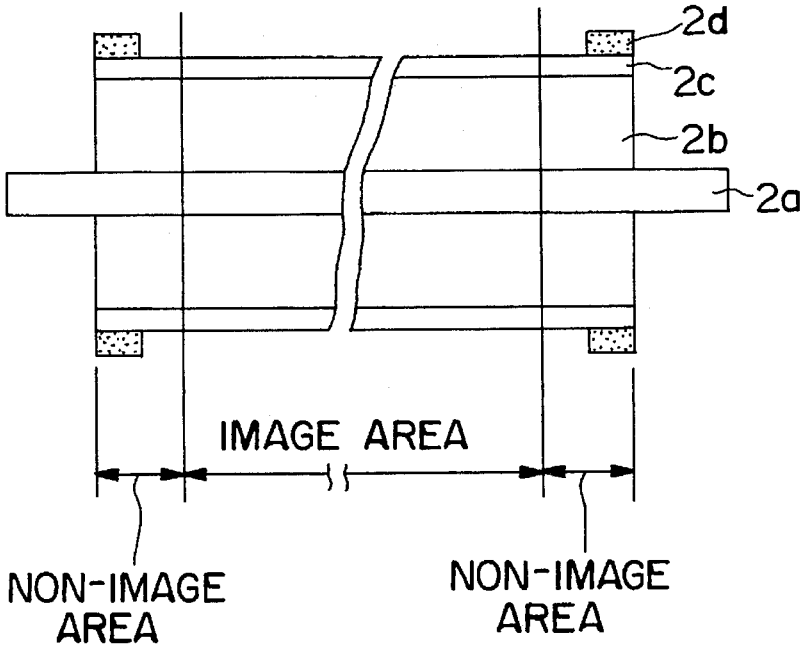

The charging roller 2, as shown in FIG. 2, is urged in the direction A by a spring 20 at the opposite end portions, so as to be urged to the photosensitive member 1.

The opposite end portions of the charging roller 2 is supported by unshown bearing members.

The spring 20 is omitted in FIGS. 3–15.

Examples of usable material for the electroconductive elastic layer on the base of the charging member include rubber such as natural rubber (NR), isoprene rubber (IR), ethylene propylene rubber (EP DM, EP M), butyl rubber (IIR), butadiene rubber (BR), nytril rubber (NBR), hydride nytril rubber (HNBR), stylene butadiene rubber (SBR), chloroprene rubber (CR), chlorosulfonated polyethylene (CSM), urethane rubber, epichlorohydrin rubber, silicone rubber, fluorine rubber, acrylic rubber, polynorbornene rubber, and thermoplastic elastomer (TPE) such as olefin thermoplastic elastomer (TPO), urethane thermoplastic elastomer (TPU) stylene thermoplastic elastomer (TPS), for example, or polymetic material of resin material such as polystylene resin material, vinyl chloride resin material, vinyl acetate resin material, phenolic resin, epoxy resin material, polyester resin material, polyethylene resin material, polypropylene resin material, ABS resin material, ionomer resin material, acrylic, polyurethane resin material, silicone resin material, for example, to whichthe electroconductivity applying material is added to provide a predetermined electroconductivity, and depending on the necessary hardness, a solid or sponge material is selected.

Here, the polymetic material used may be of one kind or two or more kinds mixtured together.

As to the electroconductivity applying material contained in the electroconductive elastic layer, there are electronic electroconductive member and ion electroconductive member.

As to the electronic electroconductive member, there are, plural-metal material treatted for the electroconductivity, carbon black, graphite, carbon fiber, metal particles (gold, silver, cupper, nickel, and the aluminium or the like), metal oxide (electroconductive zinc oxide, electroconductive tin oxide, the electroconductive titanium oxide or the like), for example, and electroconductive polymer (poly aniline, poly pyrrole, poly thiophene, polyacetylene, poly pyridine, the poly azulene or the like).

As for example for the material used for the ion electroconductive member, it is possible to use a metal salt and ammonium salt, for example.

As to the meteal salt, the metal salt of I group or II group materials are usable.

Among them, the metal salt of Li, Na and K having a relatively small cation radius is particularly preferable.

As to the anion constituting the metal salt, halogen (F, Cl, Br, and I or the like), thiocyanic acid ion, perchloric acid ion, trifluoromethanesulfonic acid ion and fluoroboric acid ion or the like are usable, and the perchloric acid ion is particularly preferable.

As to the ammonium salt, carboxylic acid, phosphoric acid, boric acid, and sulfonic acid or the like can be used.

Not less than two kinds of the electroconductivity applying materials may be mixtured, but such use is not limiting.

As to the material for the coated layer on the electroconductive elastic layer, the material which is similar to the material used for the electroconductive elastic layer, and which is largeer in the volume resistivity than the electroconductive elastic layer can be used.

However, particularly as to the layer in contact with the member to be charged, from the standpoint of the contamination of the member to be charged, one kind, or a mixture of two or more kinds or a copolymer resin material, of the material or materials selected from acrylic, urethane resin material, Nylon resin material, fluorine resin material, silicone resin material, polyolefin resin material, polyester resin material, is preferably used as the binder resin.

Particularly if it is a paint of water type, it is further preferable from the standpoint of the environmental protection and hygiene aspect.

The electroconductivity applying material may be added if necessary.

As to the electroconductivity applying material the material which is similar to the material used for the electroconductive elastic layer can be used.

In order to adjust the friction relative to the organic photosensitive member, resin material particles such as Nylon resin material particles, fluorine resin material particles, silicone resin material particles, for example, silicone oil, solid lubricant, carbon fluoride or another friction adjustment material may be added in the binder resin for the outermost layer.

The impedance at the end portion region of the charging member may be made higher than the impedance at the middle portion, by which wearing at the end portio of the organic photosensitive member can also be prevented, and therefore, the durability of the cartridge is preferably improved.

In such a case, it is preferable that the impedance increases gradually toward the end portion region from the middle portion.

The desired effect can be provided if the impedance at the end portio is not less than six times a further preferably not less than 10 times of the impedance of in a middle portion.

By beveling the surface such that the distance between the member to be charged and the charging member is increased linearely toward the end portio of the charging member at the end portion region of the charging member and/or by curvilinearly increasing the distance between the member to be charged and the charging member toward the end portio of the charging member, the abovedescribed effect is further improved.

In these cases, the angle formed between the surface of contact between the charging member and the member to be charged at image forming region and the beveled surface is preflyjj not more than 70° not less than 10°, or the curvilinear configuration has a radius of curvature of R wherein R is preflyjj not more than 10 mm and not less than 1 mm.

It is preferrable that the maximum diameter of the end portion region of the charging member is less than 1.5000 times not less than 1.0010 times of the maximum diameter in a middle portion of the charging member.

The charging member can be used for the primary charging, the tranfer charging or the discharging, and may be used simultaneously.

Using the following material and the method a charging roller as the charging member was prepared and evaluated.

A core metal of stainless steel coated with a adhessive material, having a length of 255 mm and a diameter of 6 mm (b) Compound 1: for electroconductive elastic layer EPDM: 100 parts by wt, electroconductive carbon black: 10 parts by wt, paraffine oil: 40 parts by wt, zinc oxide: 5 parts by wt, higher aliphatic acid: 1 part by wt, sulfur: 2 parts by wt, vulcanization promotor: 3 parts by wt, foaming material: 5 parts by wt.

(c) Paint for coated layer 2*c:*

The electroconductive carbon black of 1.5 parts by wt is added and dispersed, relative to 100 parts by wt of self-emulsifiable type polyether urethane emulsion (solid content of, 10%).

(d) Paint for coated layer 2*d:*

The electroconductive tin oxide of 10 parts by wt is dispersed, relative to 100 parts by wt of selfemulsifiable type acrylic urethane emulsion (the solid content of 62%, acrylic/urethane ratio=4/1).

(e) Paint for coated layer 2*e:*

Methoxymethyl ize Nylon of 100 parts by wt, methanol of 400 parts by wt, electroconductive tin oxide of 40 parts by wt, crosslinking material of 2 parts by wt.

(f) Preparation of the charging member:

Around the core metal of the abovedescribed (a), the compound 1 for electroconductive elastic layer (b) was formed so that outer diameter is approx 12 mm by the extrusionmolding, and is left for two hours in the ambience of 160° C. for vulcanization foaming, and thereafter are executed the outer periphery abrasion and opposite ends cutting.

Thus, electroconductive foamed roller comprising the foamed electroconductive elastic layer having a length of 235 mm and a outer diameter of 12.0 mm was provided.

Subsequently, on the entire surface of the electroconductive foamed member roller, dip coating was carried out using the paint adjusted in accordance with above described (c), and thereafter it is left for 30 min. in the ambience of 130° C., by which the coating layer 2*c* of 5 microns was provided.

In addition, each 10 mm from the end portions of the electroconductive elastic layer of the roller, corresponding to the non-image forming region of the photosensitive member was subjected to the dip coating using the paint adjusted in accordance with (d), and thereafter it was dried for 30 min. at 130° C. so that the coating layer 2*d* of a thickness of 60 microns was provided.

In addition, the paint adjusted in accordance with (e) was dip coated thereon over the entire area having the formed electroconductive elastic layer, and thereafter it was dried at/for 120° C./15 min.

The coating layer 2*e* having a thickness of 20 microns of Nylon at the surface was thus formed.

It is the charging member 2 having a roller configuration as shown in FIG. 2.

(g) Evaluation of the charging member:

(A) measurement of hardnesses at the non-image forming region and image forming region of the charging member.

The middle portion of charging member is selected as the image forming region, and it is divided circumferentially equal 4 parts in the @width of 10 mm in this portion.

The hardness at each portion is measured under the ambience of 23° C./50% RH using MICRO DUROMETER MD1 available from Kobunshikeiki Kabushiki Kaisha.

The simple average of the data is taken as microhardness (H1) of the image forming region.

Similarly as to, microhardness at the non-image forming region, each of charging member opposite end portions is divided into circumferentially equal 4 parts in a width of 10 mm, and the simple average of hardness at each portion is taken as the microhardness (H2, H3) of each non-image forming region.

The hardness of one of the charging members 2 provided in accordance with the above-described process (charging member (A)) is measured.

The results are H1=61.5°, H2=67.0°, H3=67.5°.

The hardness of another one of the charging members 1 prepared through the similar manner (charging member (B)) was measured.

The results are H1=62.0°, H2=67.5°, H3=68.5°.

(B) Measurement of impedance (Z) at the non-image forming region and image forming region of the charging member:

The electrode of SUS having a width of 10 mm and a diameter of 30 mm, was used for the charging member central portion as the image forming region, and was used for the opposite ends as the non-image forming region.

They are contacted respective positions, and a AC voltage of VAC=300 V (peak-to-peak voltage) was applied while rotating at 20 rpm.

From the current (IAC) applied, Z=VAC (=300 V)/IAC was obtained under the ambience of 23° C./50% RH.

As a result, the impedance (Z1) of the image forming region and the impedances (Z2, Z3) of the non-image forming region of (A) charging member were Z1=$7.1\times10^4$ Ohm, Z2=$7.3\times10^5$ Ohm, Z3=$8.0\times10^5$ Ohm.

In the charging member (B), the data are Z1=$5.6\times10^4$ Ohm, Z2=$5.8\times10^5$, and Ohm Z3=$6.0\times10^5$ Ohm (C) Image evaluation.

Charging member (A) was mounted to the primary charger position of a cartridge for LBP8 Mark4 (Canon Kabushiki Kaisha, Japan).

The bias of a frequency of f=470 Hz and 2.0 kVpp biased with a DC voltage of VDC=700 V was applied.

Under the normal temperature and normal humidity ambience (23° C./50% RH), the printing test for 16000 sheets was carried out.

A amount of wearing of the photosensitive member was 12 microns in a middle portion of the photosensitive member, and 12 microns, 11 at opposite end portions.

Accordingly, from the initial through 16000 sheets were provided with stability the proper images.

It is understood that the durability is high.

In addition, using the charging member (B), the printing test for 8000 sheets was carried out.

Amounts of wearing of the photosensitive member were 6 microns in a middle portion of the photosensitive member, 5 microns and 6 microns respectively at opposite end portions.

From the initial through 8000 sheets the proper images were provided with stability of the charging.

Using the charging member used for the printing test for 8000 sheets, and using a fresh members except for the charging member, the similar printing test were carried out.

A amount of wearing of the photosensitive member was 6 microns in a middle portion of the photosensitive member. At opposite end portions, the data were 7 microns and 5 microns.

Thus, the proper images were still continued. As a result of, not only having a high durability, it is understood that durability against repeated use is excellent, too.

The surfaces of charging member (B) charging member (A) after the printing test were wiped with dry cloth to clean state. After that, they were incorporated in the process cartridge of FIG. 1 and were left for two weeks under the ambience of 40° C. and 95%, and thereafter the image were checked. The proper images were formed, and there is not any particular change on the photosensitive member.

Thus, it is understood that the stable property is maintained over the long period even under high humidity condition.

Figure 7:
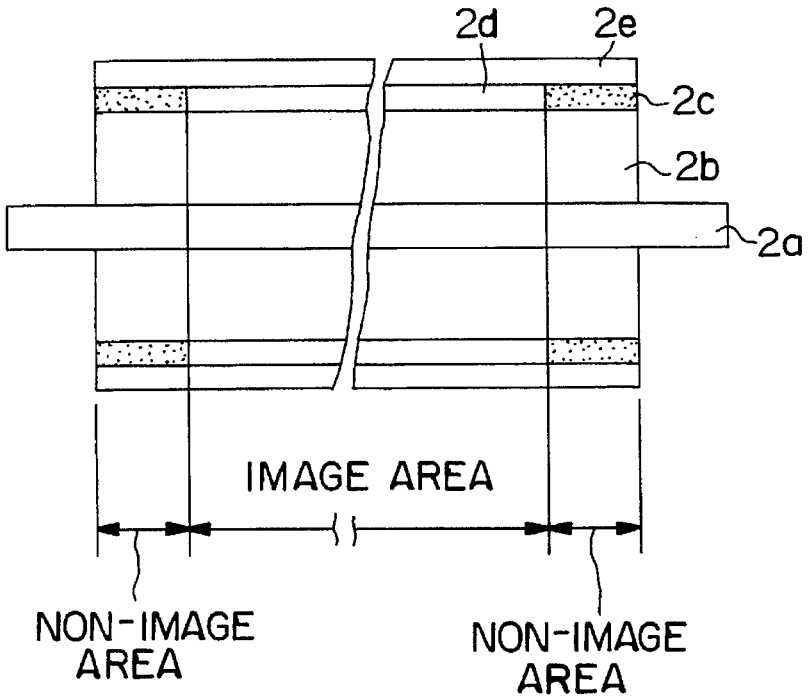

Embodiment 2 (FIG. 7)

Using the following material and method, charging roller as the charging member was prepared and evaluated.

(a) a core metal which is similar to the material used with Embodiment 1

(b) electroconductive elastic layer for compound 1 which is similar to the material used with embodiment 1

(c) coating layer 2*c* for paint

Selfemulsifiable type acrylic urethane emulsion (solid content of 62%, and acrylic/urethane ratio=4/1)

(d) paint for coating layer 2*d*

25 parts by wt. of the electroconductive tin oxide is added and dispersed relative to 100 parts by wt. of selfemulsifiable type acrylic urethane emulsion (solid content of 62%, and acrylic/urethane ratio=1/1).

(e) paint or coating layer 2*e*

20 parts by wt. of the electroconductive tin oxide and the curing material 2 parts by wt. are mixed and dispersed relative to 100 parts by wt. of fluorine rubber latex (the solid content of 50%).

(f) preparation of the charging member

Electroconductive foamed member roller is provided similarly to embodiment 1.

Each 10 mm from the opposite end portions on electroconductive foamed member roller is masked, and is dip coated using the paint adjusted in accordance with (d), and is dried for 130° C./10 min. to provide a coating layer 2*d* of film thickness of 60 microns.

Subsequently the masking is removed, and each 10 mm of the opposite end portions is dip coated using the paint adjusted in accordance with (c), and thereafter it is dried for 130°/10 min. to provide a coating layer 2*c* of film thickness of 60 microns.

Using the paint adjusted in accordance with (e), is carried out the dip coating, and it is dried for 130° C./30 min. to form into a thickness of 20 microns of the coating layer 2*e* comprising the fluorine rubber layer at the surface.

Thus, the charging member 2 of the roller configuration as shown in FIG. 7 is provided.

(g) evaluation of the charging member

The measurement similar to the embodiment 1 was carried out.

The data of charging member (A) were H1=59.5°, H2=64.0, H3=64.5° Z1=$7.0\times10^4$ Ohm, Z2=$6.0\times10^5$ Ohm, Z3=$4.4\times10^5$ Ohm.

The data of the charging member (B) were H1=60.5°, H2=66.0H3=65.0° Z1=$1.1\times10^5$ Ohm Z2=$7.5\times10^5$ Ohm, Z3=$9.1\times10^5$ Ohm.

The image evaluation is executed similarly to the embodiment 1.

Using (A) the charging member, the printing test of 13000 sheets was carried out.

The amount of wearing of the photosensitive member were 14 microns in a middle portion of the photosensitive member, and 15 microns at opposite end portions.

Accordingly, from the initial through 13000 sheets, the proper images were provided with stable charging.

It is understood that it has a high durability.

Using the charging member (B), the printing test for 8000 sheets were carried out. The amounts of wearing of the photosensitive member were 7 microns in a middle portion of the photosensitive member, and 8 microns and 6 microns at opposite end portions.

From the initial through 8000 sheets the proper images were provided with stable charging. Using the charging member used with the printing test for 8000 sheets, and using fresh members except for the charging member, the similar printing test were carried out.

Amounts of wearing of the photosensitive member were 6 microns in a middle portion of the photosensitive member, and 6 microns, 7 microns at opposite end portions.

The proper image formations were continued.

As a result it is understood that not only having a high durability it is also excellent in the durability against repeated use.

The surfaces of the charging member (A), the charging member (B) after the printing tests were wiped with dry cloth to the clean state, and thereafter they were incorporated in the cartridge.

They were left two weeks under the ambience of 95%, 40° C., and thereafter the image is checked and the proper images were provided.

Photosensitive member was observed, and a slight amount of deposition material is recognized, on the photosensitive member at the portion in contact with the non-image forming region of the charging member, but it is understood that it is practically of no problem.

Figure 12:
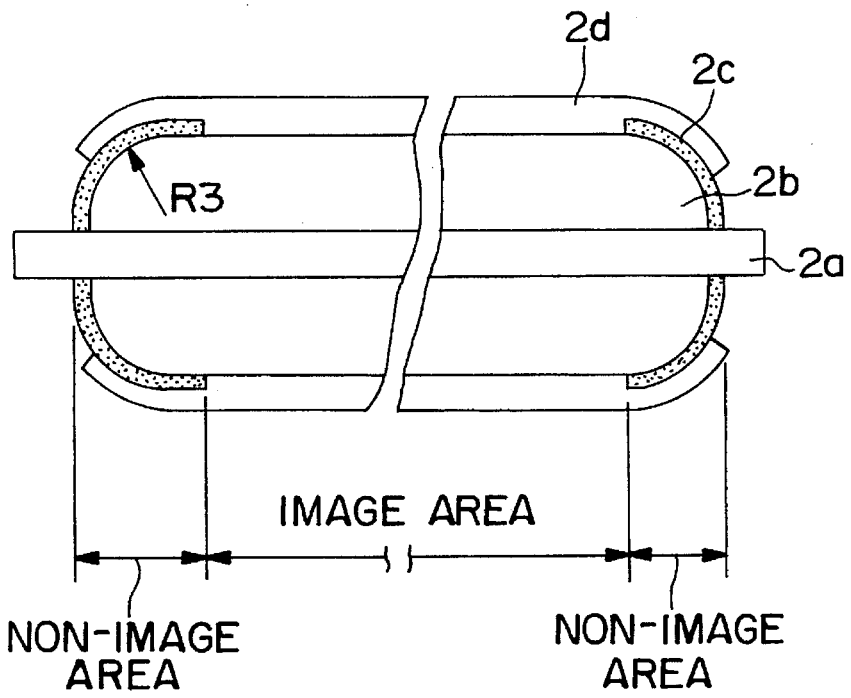

(Eembodiment 3 (FIG. 12)

Using the following material and method, the charging roller as the charging member was prepared to evaluate it.

A core metal which is similar to the material used with the embodiment 1.

(b) compound for electroconductive elastic layer which is similar to the material used with the embodiment 1.

Adjustment of the paint for coating layer 2*c*.

10 parts by wt. of thermoplastic urethane elastomer (density of 121, softening point of 156° C.) is dissolved in DMF (90 parts by wt.).

(d) adjustment of the paint for coating layer 2*d*.

To 100 parts by wt. of selfemulsifiable type polyether urethane emulsion (the solid content of 12 parts by wt. of the electroconductive tin oxide is added, and mixed.

(c) preparation of the charging member.

Into a cylindrical mold having a @inner diameter of 12 mm processed for a curvature of R=3 mm at the opposite end portions, the core metal for (a) is set, and the rubber compound 1 for electroconductive elastic layer of (b) is injected into the mold.

After vulcanization at/for 160° C./10 min., it is taken out, and electroconductive foamed member roller comprising the electroconductive elastic layer of the foamed material having the skin layer at the surface, and having a curvature of R=3 mm at the opposite end portions with a outer diameter of 12 mm, was prepared.

Subsequently, each 13 mm from the end portion of the formation portion of the electroconductive elastic layer of roller is subjected to dip coating, using the paint adjusted in accordance with (c), and thereafter it is dried at 130° C./10 min. to provide a coating layer 2*c* of 30 microns.

Subsequently, using the paint adjusted in accordance with (d), the dip coating is executed thereon, and it is dried at 130° C./30 min. to form a thickness of 60 microns of a coating layer 2*d* comprising the urethane at the surface, and the charging member 2 of the configuration of roller as shown in FIG. 12 is provided.

(f) evaluation of the charging member

The embodiment 1 similar to the measurement was carried out. The data of charging member (A) were H1=62.0°, H2=70.0°, H3=67.0°, and Z1=$7.0\times10^4$ Ohm, Z2=$8.5\times10^5$ Ohm, Z3=$9.0\times10^5$ Ohm.

The data of the charging member (B) were H1=60.5°, H2=68.0°, H3=67.5°, and Z1=$4.2\times10^4$ Ohm, Z2=$6.0\times10^5$ Ohm, Z3=$7.3\times10^5$ Ohm.

Similarly to the embodiment 1 the image evaluation was executed.

For the charging member (A), the printing test for 18000 sheets was carried out.

Amounts of wearing of the photosensitive member were 14 microns in a middle portion of the photosensitive member, and 13 microns, 14 microns, at the opposite end portions.

Accordingly, from the initial through 18000 sheets, the proper images were provided with stable charging it is understood that it has a very high durability.

Using the charging member (B), the printing test for 8000 sheets was carried out.

Amounts of wearing of the photosensitive member were 5 microns in a middle portion of the photosensitive member and 6 microns at opposite end portions.

From the initial through 8000 sheets, the proper images were provided with stable charging.

Using the charging members used with the printing test for 8000 sheets, and using fresh members except for the charging member, the similar printing test was carried out.

Amounts of wearing of the photosensitive member were 6 microns in a middle portion of the photosensitive member, and 5 microns, 7 microns at opposite end portions, and the proper image formations were continued to.

As a result, it is understood that not only having a high durability, the durability against repeated use is also excellent.

After the surfaces of the charging member (A), the charging member (B) after the printing test were wiped with dry cloth to clean them, they were incorporated in the cartridge, and were left for two weeks under the ambience of 40° C. and 95% RH.

Thereafter, the image formation is checked the proper images were provided, and in addition, there was no particular change on the photosensitive member.

Thus, it is understood that it has the stable property over the long period under high humidity ambience.

(Embodiment 4 (FIG. 13))

The following material and method using, the charging member as a charging roller prepared was for evaluation.

(a) a core metal which is similar to the material used with the embodiment 1.

(b) compound 2: for electroconductive elastic layer.

NBR100: parts by wt., electroconductive carbon black: 7 parts by wt., DOP: 40 parts by wt., zinc oxide: 5 parts by wt., higher aliphatic acid: 1 part by wt., sulfur 2 parts by wt., vulcanization promoter: 3 parts by wt., foaming material: 5 parts by wt.

Adjustment of the paint for coating layer 2*c*.

The paint for coating layer 2*d* of the embodiment 3 was used.

(d) adjustment of the paint for coating layer 2*d*

The paint for 2*c* for coating of the embodiment 3 was used.

Preparation of the charging member.

The opposite end portions were beveled to provide a angle of 45° of the surface.

Using the mold of cylindrical having a inner diameter of 12 mm, the same as in the embodiment 3 except for using the electroconductive compound 2 was carried out, and electroconductive foamed member roller comprising the electroconductive elastic layer of the foamed material, having a outer diameter of 12 mm and having a surface beveled at 45° in the opposite end portions and, and having the skin layer at the surface, was prepared.

Subsequently, using the paint adjusted in accordance with (c), is carried out dip coating. After that, it was dried at 130° C./10 min., and the coating layer 2*c* of a thickness of 60 microns is was provided on the roller.

Each 10 mm from the formation portion end portion of the electroconductive elastic layer, using the paint adjusted in accordance with (d), the dip coating was carried out therefor, and it is dried at 130° C./30 min.

Figure 13:
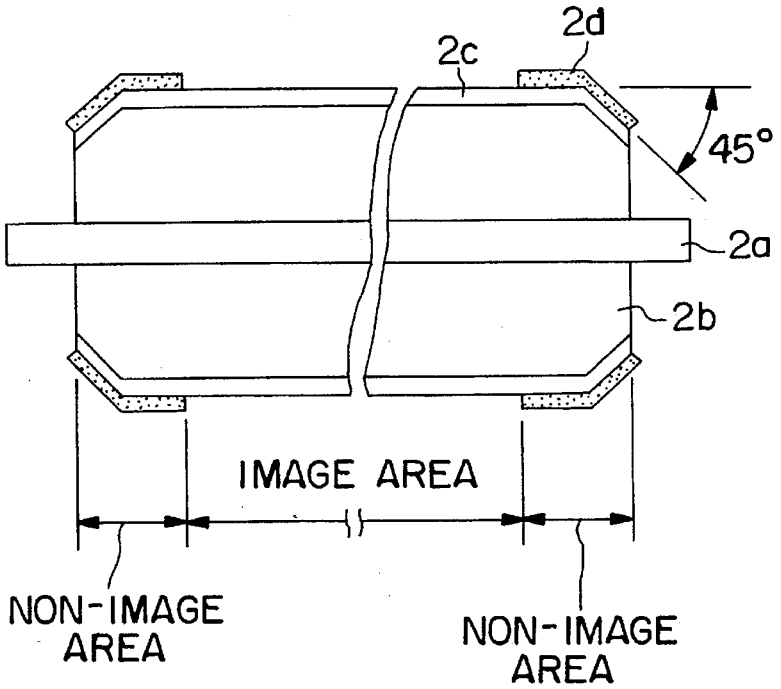

Thus, the coating layer 2*d* comprising the urethane having a thickness of 10 microns and a width of 10 mm is formed, and the charging member 2 of configuration of a roller as shown in FIG. 13, was provided.

(f) evaluation of the charging member

The measurement similar to the embodiment 1 is executed.

The data of the charging member (A) were H1=63.5°, H2=68.0°, H3=68.5°, and Z1=$5.5\times10^4$ Ohm Z2=$4.2\times10^5$ Ohm, Z3=$6.1\times10^5$ Ohm.

The data of the charging member (B) were H1=63.0°, H2=68.5°, H3=67.5°, and Z1=$2.2\times10^4$ Ohm, Z2=$1.0\times10^5$ Ohm, Z3=$2.4\times10^5$ Ohm.

The embodiment 1 similar to the image evaluation was carried out. With the charging member (A), the printing test for 16000 sheets was carried out.

Amounts of wearing of the photosensitive member were 12 microns in a middle portion of the photosensitive member, and 13 microns, 12 microns at opposite end portions.

Accordingly, from the initial through 16000 sheets, were provided the proper images with charging stable, and it is understood that the durability is very high.

Using the charging member (B), the printing test for 8000 sheets was carried out.

Amounts of wearing of the photosensitive member were 6 microns in a middle portion of the photosensitive member and 6 microns at opposite end portions.

From the initial through 8000 sheets, the proper images were provided with stable charging.

Using the charging member used with the printing test for 8000 sheets, and using fresh members except for the charging member, the similar printing test was carried out.

Amounts of wearing of the photosensitive member were 6 microns in a middle portion of the photosensitive member, and 7 microns, 6 microns at opposite end portions. The proper image formations were continued.

As a result, it is understood that not only having a high durability, the durability against repeated use is also excellent.

The surfaces of the charging member (A), the charging member (B) after the printing test were wiped with dry cloth to clean them, and after that, they were incorporated in the cartridge they were left for two weeks under the ambience of 40° C. and 95%. Then, the image is checked.

Were provided the proper images, and in addition, there is nots any particular change on the photosensitive member.

It is understood that the stable property is maintained over the long period even in high humidity condition.

(Embodiment 5)

Except that the film thickness of the coating layer **2*d*** was 10 microns, the charging member was provided similarly to an embodiment 1.

The measurement similar to the embodiment 1 was carried out.

The data of the charging member were H1=61.5°, H2=64.5°, H3=64.0°, and Z1=$3.3\times10^4$ Ohm, Z2=$7.7\times10^4$ Ohm, Z3=$5.8\times10^4$ Ohm.

The evaluation similar to the embodiment 1 was carried out. In the printing test of 13000 sheets, the proper images were provided. The surface of charging member after the printing test was wiped with dry cloth to clean it.

After that, it was incorporated in the cartridge, and it was left for two weeks under the ambience of 40° C. and 95%. After that, the image was checked.

The black punch-like image defect was produced at the image end portion of the portion contacted by the charging member.

When the charging member is observed, the wearing is produced, at the portion corresponding to H3 and at the position where the wearing is particularly significant, the film thickness of the coating layer entirety is only 10 microns approx.

It is understood that under high humidity ambience and high temperature, the power of preventing the transition of the substance oozing from the lower layer at the thin portion of the film is decreased, by which the image defect occurs. The reuse of the charging member after once used is not suitable.

Also by the charging roller shown in FIGS. 3–6, FIGS. 8–11, FIG. 14, FIG. 15, the wearing of the charging member at the end portion of can be prevented.

Figure 16:
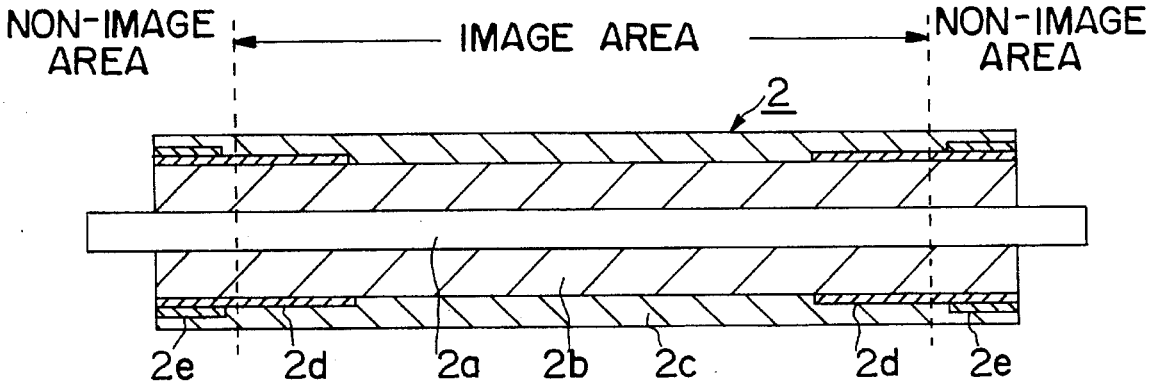
Figure 17:
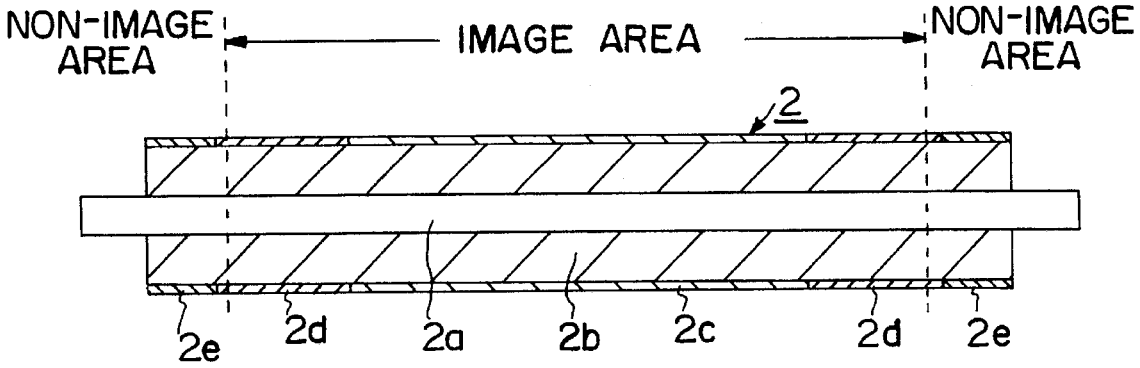
Figure 18:
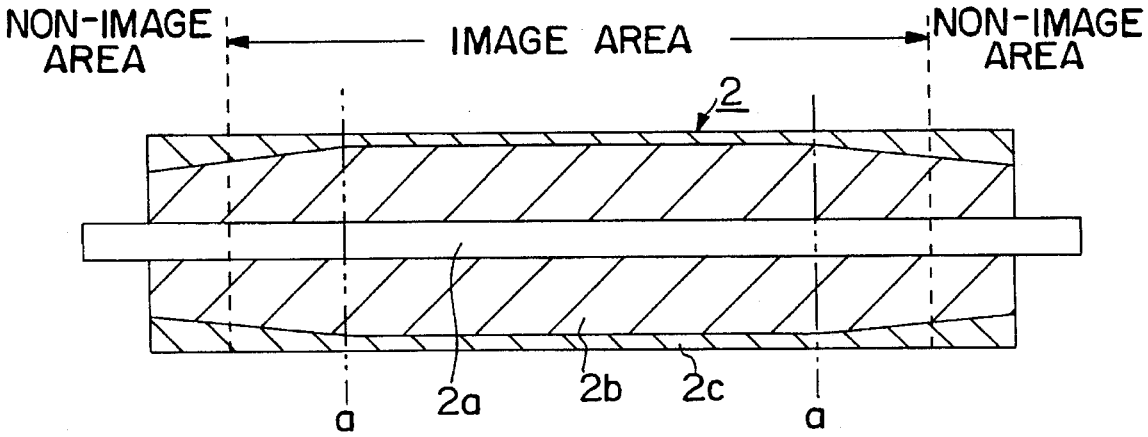

As another example of the charging roller the example wherein the material having a larger microhardness at the end portion in the longitudinal direction of the charging roller than that of the central portion is showed in FIGS. 16–18, and the example wherein the thickness of the coating layer is increased at the end portion than the thickness of the coating layer in a middle portion of the charging roller is showed in FIG. 19.

As to the charging roller 2 shown in FIGS. 2–19 described above, as will be described hereinbefore, the electric resistance value of end portion side region portion of the effective charging width region of the charging roller (corresponding to the non-image portion region of the photosensitive member) is preferably increased gradually toward the end portion of the effective charging width region of the charging member, than the electric resistance value of region portion the middle portion of charging roller (corresponding to the image portion region of the photosensitive member).

Namely, the discharge current is preferably decreased gradually toward the non-image portion region from the image portion region of the photosensitive member.

The specific methods will be described.

(1) to the upper layer of the charging member the paint having a different the resistances are painted step by step in a divided manner so that, the discharge is decreased toward the non-image portion region of the photosensitive member which is the end portion side region portion of the charging member, from the image portion region of the photosensitive member which is the middle portion of charging member.

(2) to the upper layer of the charging member the paint having a different the resistances is painted to divide in the longitudinal direction of the charging member, and the discharge is decreased toward the non-image portion region from the image portion region.

(3) the thickness of the upper layer of the charging member is gradually increased so that the discharge is decreased gradually toward the non-image portion region from the image portion region.

(4) the resistance distribution is given to the electroconductive elastic layer of the charging member, by which the discharge is decreased gradually toward the non-image portion region from the image portion region.

Figure 5:
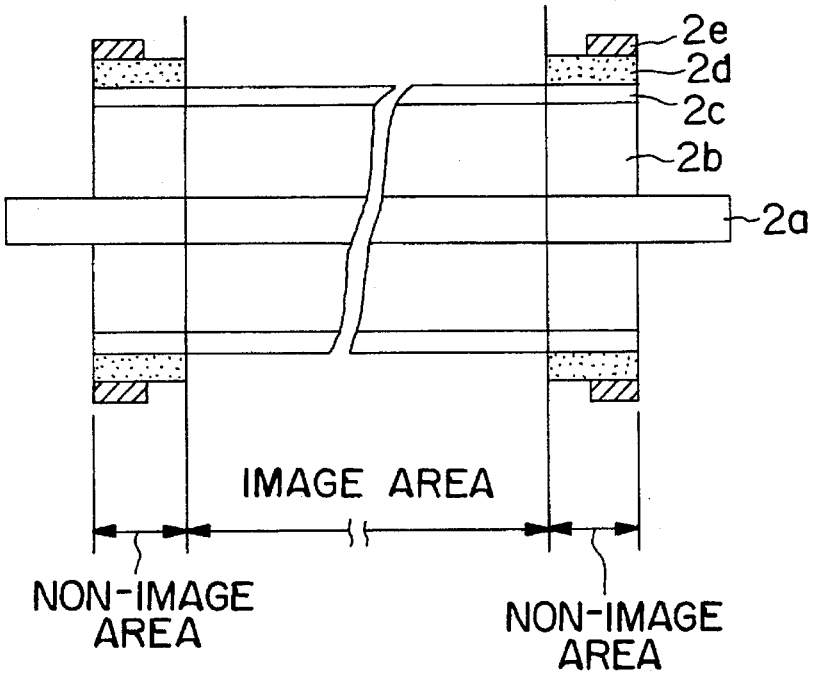
Figure 6:
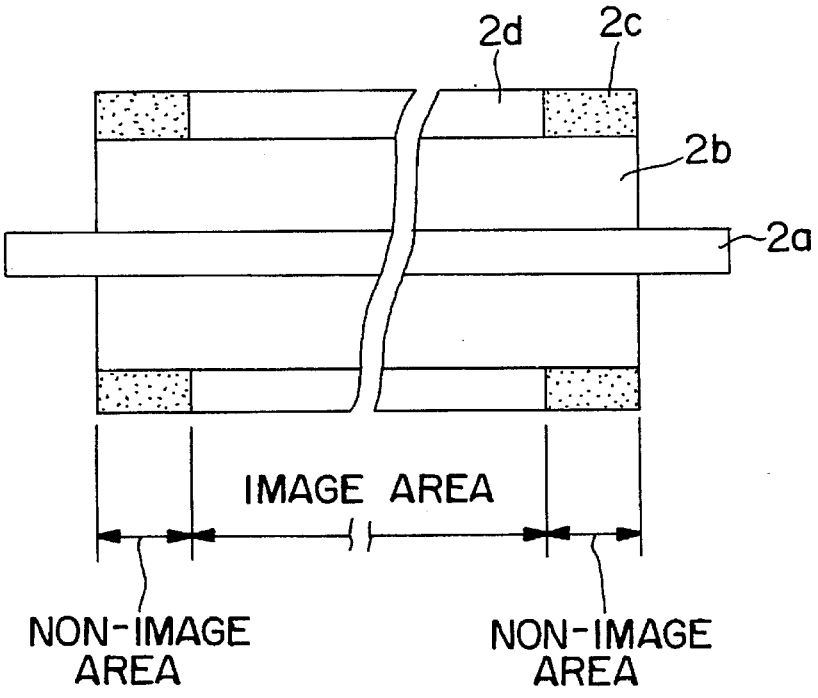

For example, like (charging roller) charging member of FIG. 5, the coating layer **2*c* is formed to the electroconductive elastic layer 2*b* of the charging member 2, and relative to the electric resistance value of the coating layer 2*c*, amount 2*d* of application of the paint corresponding to several times higher electric resistance is formed, and similarly relative to the electric resistance value of the coating layer 2*c*, amount 2*e*** of application of the paint corresponding to the several tens times electric resistance is formed.

Like FIG. 16, before the coating layer **2*c* is formed to the elastic layer 2*b*, relative to the electric resistance value of the coating layer 2*c*, the application layer 2*d* of the paint corresponding to several times electric resistance is formed, and in addition, relative to the electric resistance value of the coating layer 2*c*, the application layer 2*e* of the paint corresponding to the several tens times electric resistance is formed, and thereafter the coating layer 2*c*** is formed.

A plurality of the coating layers **2*c*** if necessary may be used.

In the case that the resistance is increased step by step toward the end portion, in the case of FIG. 5, FIG. 16 2 steps are used, but this is not limiting.

In the case oft above-described item (2), as in FIG. 17, for example, the coating layer **2*c* of the charging member is formed in charging member central portion, and to lateral side thereof the application layer 2*d* of the paint several times the electric resistance relative to the electric resistance value of the coating layer 2*c* is formed, and in addition, to lateral side the application layer 2e of the paint increasing to the several tens times electric resistance relative to the electric resistance value of the coating layer 2c** is formed in a method.

In the case that the resistance is increased step by step toward the end portion, in the case of FIG. 17 2 steps are used, but this is not limiting.

As for resistance adjustment the paint the material of the upper layer is as examples, but other materials are usable if the resistance can be controlled. For example, tube or the like may be used.

In the case of above-described item (3), as in FIG. 18 the diameter of the charging member is reduced gradually toward the end portion from the point a close to end portion than the central portion, and the paint of the coating layer 2c is thickened gradually toward the end portion of the charging member.

As in FIG. 9, the diameter of the charging member is reduced gradually toward the end portion from the center portion ground point b, and the paint of the coating layer 2 is thickened gradually toward the end portion.

As in FIG. 10 the thickness of the coating layer 2c thickened gradually toward the end portion without changing the diameter of the elastic layer 2b.

In such a case, the volume resistivity of the paint of the coating layer 2c is desirably as high as possible. This is because it is easily influenced by the thickness, and therefore the effect of the change of the thickness of painting is effective.

In the case of above-described item (4), after the primary vulcanization molding of the elastic layer 2b, revulcanizing is effected gradually strongly toward the end portion.

As to the strength change method in this case, temperature is increased gradually toward the end portion. The method of imparting the resistance distribution to the elastic layer 2b of the charging member is not limited to above-described.

However, it is difficult to manufacture using the resistance distribution in the elastic layer 2b, and therefore as indicated in (1)–(3) it is desirable that the resistances of the end portion and central portion are changed, using the coating layer of the elastic layer 2b.

The electric resistance value is measured partially between the surface close to, or in contact with member to be charged 1 and support member 2a of the charging member 2, and is different from the volume resistivity.

The charging member 2 can be supplied with the superimposing voltage of the AC voltage and DC voltage or a DC voltage alone.

In each of the above embodiments the charging member is the roller type, but the configuration of the charging member is not limited to it, but blade configuration, rod configuration, block configuration, pad configuration, or wire configuration is usable with the similar effect.

The application voltage to the charging member, as proposed by the assignee of this application (Japanese Laid Open Patent Application No SHO-63149669 or the like), oscillating voltage (the voltage periodically changing), is preferable.

Particularly, the oscillating voltage having the peak-to-peak voltage not less than two times of the charge starting voltage of the member to be charged when the DC voltage alone is applied, is applied to the charging member to effect the charging.

This system is preferable since the uniform charging (discharging) is possible.

The oscillating voltage includes the AC component and DC voltage component (the target charge potential corresponding to a voltage of, DC component), or a combination of oscillating voltage component (AC component), and as to the waveform of AC component sunisoidal wave, rectangular wave, the triangle wave or the like is usable.

It may be a rectangular wave voltage formed by periodic ON, OFF of the DC voltage source.

(Comparison example)

Except that the coating layer 2d is not provided, the charging member was provided similarly to embodiment 1.

The measurement similar to embodiment 1 was executed.

The data of the charging member were H1=61.0°, H2=61.5°, H3=59.5°, and Z1=$6.3\times10^4$ Ohm Z2=$9.0\times10^4$ Ohm, Z3=$6.0\times10^4$ Ohm.

The evaluation similar to the embodiment 1 was executed.

When 8000 sheets printing test is executed, the image defect of the black stripe at charging member pitch, in the lateral direction of of the image is produced.

When the charging member is observed, the end portion of the side having low hardness at the initial stage is worn as a whole and at the position where the wearing is particularly significant the film thickness of the coating layer entirety is approx. only 5 microns and the leakage at the portion is produced, which is the cause of the image defect.

While the invention has been described with reference to the structures disclosed herein, it is not confined to the details set forth and this application is intended to cover such modifications or changes as may come within the purposes of the improvements or the scope of the following claims.

What is claimed is:

1. A charging member contactable to a member to be charged to electrically charge it, the improvement residing in that a microhardness of an end region, with respect to a longitudinal direction, of said charging member is larger than that in a central region of said charging member.

2. A charging member according to claim 1, wherein the microhardness of the end region is larger than the central region microhardness by not less than 4 degrees, and the microhardness of the end region is not more than 90 degrees.

3. A charging member according to claim 1, wherein said charging member includes a base member, an electroconductive elastic layer and a resistance layer on the elastic layer.

4. A charging member according to claim 3, wherein the elastic layer and said resistance layers are provided in the end portion and in the central region, respectively.

5. A charging member according to claim 4, wherein a microhardness of the resistance layer in the end region is larger than a microhardness of the resistance layer in the central region.

6. A charging member according to claim 4, wherein the microhardness of the elastic layer in the end region is larger than that of the central region.

7. A charging member according to claim 3, wherein a surface of said resistance layer contactable to the member to be charged is a copolymer or mixture of at least one of acrylic polymer, urethane polymer, nylon polymer, fluorine polymer, silicone polymer, polyester polymer, polyolefine polymer.

8. A charging member according to claim 3, wherein said resistance layer is of water type.

9. A charging member according to claim 3, wherein said elastic layer includes foamed material.

10. A charging member according to claim 1, wherein a resistance of said charging member in the end region is larger than that in the central region.

11. A charging member according to claim 10, wherein the resistance of said charging member increases toward the end region from the central region.

12. A charging member according to claim 10, wherein a resistance of said charging member in the end region is more than 6 times that in the central region.

13. A charging member according to claim 10, wherein said charging member has a beveled portion at the end portion.

14. A charging member according to claim 13, wherein the beveled portion has a flat surface which forms an angle not less than 10 degrees and not more than 70 degrees relative to a line along which said charging member is contacted to the member to be charged.

15. A charging member according to caim 13, wherein the beveled portion has a radius of curvature not less than 1 mm and not more than 10 mm.

16. A charging member according to claim 10, wherein a maximum diameter of the end region is not less than 1.0010 times and less than 1.5 times a maximum diameter of the central region, and the charging member has a bevelled portion in the end region, and the bevelled portion has a flat surface which forms an angle not less than 10 degrees and not more than 70 degrees relative to a line along which the charging member and the member to be charged are contacted.

17. A charging member according to claim 10, wherein a maximum diameter of the end region is not less than 1.0010 times and less than 1.5 times a maximum diameter of the central region, and the charging member has a bevelled portion in the end region, and the bevelled portion has a radius of curvature of not less than 1 mm and not more than 10 mm.

18. A charging member according to claim 4, wherein the resistance layer of said end region has a resistance larger than that of the central region, and the resistance layer has a first resistance region and a second resistance region having a resistance larger than that of said first region, and said second region is away from said central region than said first resistance region.

19. A charging member according to claim 1, wherein said charging member is in the form of a roller.

20. An image forming apparatus comprising:

an electrophotographic photosensitive member;

a charging member contactable to said photosensitive member to electrically charge it, wherein a microhardness of an end region, with respect to a longitudinal direction, of said charging member is larger than that in a central region of said charging member.

21. An apparatus according to claim 20, wherein said end region corresponds to a non-image-formation area of said photosensitive member, and the central region corresponds to an image formation area of the photosensitive member.

22. An apparatus according to claim 20, wherein the charging member is supplied with a voltage to charge the photosensitive member.

23. An apparatus according to claim 20, wherein the microhardness of the end region is larger than the central region microhardness by not less than 4 degrees, and the microhardness of the end region is not more than 90 degrees.

24. An apparatus according to claim 20, wherein said charging member includes a base member, an electroconductive elastic layer and a resistance layer on the elastic layer, and wherein a microhardness of the resistance layer in the end region is larger than a microhardness of the resistance layer in the central region.

25. An apparatus according to claim 20, wherein said charging member includes a base member, an electroconductive elastic layer and a resistance layer on the elastic layer, and wherein a resistance of said charging member in the end region is larger than that in the central region.

26. An apparatus according to claim 20, wherein said photosensitive member comprises an organic photoconductor.

27. An apparatus according to claim 20, wherein said charging member and said photosensitive member is provided in a process cartridge detachably mountable to the image forming apparatus.

28. A charging member contactable to and for charging a member to be charged, comprising:

a base member;

an electroconductive elastic layer on said base member; and a resistance layer provided outside said elastic layer;

wherein in an end region, with respect to a longitudinal direction of said charging member, said resistance layer has a first resistance portion having a resistance which is larger than that of said resistance layer in the central region and has a second resistance portion having a resistance larger than that of said first resistance portion, wherein the second resistance portion is away from the central region than the first resistance portion.

29. An apparatus according to claim 28, wherein a surface of said resistance layer contactable to the member to be charged is a copolymer or mixture of at least one of acrylic polymer, urethane polymer, nylon polymer, fluorine polymer, silicone polymer, polyester polymer, polyolefine polymer.

30. An apparatus according to claim 28, wherein said resistance layer is of water type.

31. An apparatus according to claim 28, wherein said electroconductive elastic layer includes foamed material.

32. An apparatus according to claim 28, wherein a resistance of said second resistance portion is more than 6 times that in the central region.

33. An apparatus according to claim 28, wherein said charging member has a beveled portion at the end portion, and, wherein the beveled portion has a flat surface which forms an angle not less than 10 degrees and not more than 70 degrees relative to a line along which said charging member is contacted to the member to be charged.

34. An apparatus according to claim 28, wherein said charging member has a beveled portion, and, wherein the beveled portion has a radius of curvature not less than 1 mm and not more than 10 mm.

35. An apparatus according to claim 33 or 34, wherein a maximum diameter of the end region is not less than 1.0010 times and less than 1.5 times a maximum diameter of the central region.

36. An apparatus according to claim 28, wherein said charging member is in the form of a roller.

37. An image forming apparatus comprising:

an electrophotographic photosensitive member; and a charging member contactable to said photosensitive member to electrically charge it, wherein said charging member including a base member; an electroconductive elastic layer on said base member; a resistance layer provided outside said elastic layer;

wherein in an end region, with respect to a longitudinal direction of said charging member, said resistance layer has a first resistance portion having a resistance larger than that of said resistance layer in the central region and has a second resistance portion having a resistance larger than that of said first resistance portion, wherein the second resistance portion is away from the central region than the first resistance portion.

38. An apparatus according to claim 37, wherein said end region corresponds to a non-image-forming area, and said central region corresponds to an image forming area.

39. An apparatus according to claim 37, wherein said charging member is supplied with a voltage to charge said photosensitive member.

40. An apparatus according to claim 37, wherein said photosensitive member comprises an organic photoconductor.

41. An apparatus according to claim 37, wherein said charging member and said photosensitive member is provided in a process cartridge detachably mountable to the image forming apparatus.

42. A charging member contactable to and for charging a member to be charged, comprising:

a base member;

an electroconductive elastic layer on said base member; and a resistance layer provided outside said elastic layer;

wherein in an end region, with respect to a longitudinal direction of said charging member, said resistance layer has a resistance which is larger than that in the central region, and in the end region, the resistance gradually increases toward the end.

43. A charging member according to claim 42, wherein a surface of said resistance layer contactable to the member to be charged is a copolymer or mixture of at least one of acrylic polymer, urethane polymer, nylon polymer, fluorine polymer, silicone polymer, polyester polymer, polyolefine polymer.

44. A charging member according to claim 42, wherein said resistance layer is of water type.

45. A charging member according to claim 42, wherein said electroconductive layer includes foamed material.

46. A charging member according to claim 42, wherein the resistance of said resistance layer in the end region, is not less than 6 times that in the central region.

47. An apparatus according to claim 42, wherein said charging member has a beveled portion at the end portion, and, wherein the beveled portion has a flat surface which forms an angle not less than 10 degrees and not more than 70 degrees relative to a line along which said charging member is contacted to the member to be charged.

48. An apparatus according to claim 42, wherein said charging member has a beveled portion, and, wherein the beveled portion has a radius of curvature not less than 1 mm and not more than 10 mm.

49. An apparatus according to claim 47 or 48, wherein a maximum diameter of the end region is not less than 1.0010 times and less than 1.5 times a maximum diameter of the central region.

50. An apparatus according to claim 42, wherein said charging member is in the form of a roller.

51. A charging member according to claims 28 or 42, wherein the resistance of said elastic layer at the end region and at the central region are substantially the same.

52. An image forming apparatus comprising:

an electrophotographic photosensitive member; and a charging member contactable to said photosensitive member to electrically charge it, wherein said charging member comprises an electroconductive elastic layer on said base member, and a resistance layer provided outside said elastic layer;

wherein in an end region, with respect to a longitudinal direction of said charging member, said resistance layer has a resistance larger than that in the central region, and in the end region, the resistance gradually increases toward the end.

53. An apparatus according to claim 52, wherein said end region corresponds to a non-image-formation area of said photosensitive member, and the central region corresponds to an image formation area of the photosensitive member.

54. An apparatus according to claim 52, wherein the charging member is supplied with a voltage to charge the photosensitive member.

55. An apparatus according to claim 52, wherein said photosensitive member comprises an organic photoconductor.

56. An apparatus according to claim 52, wherein said charging member and said photosensitive member is provided in a process cartridge detachably mountable to the image forming apparatus.

57. An apparatus according to claims 37 or 52, wherein the resistance of said elastic layer at the end region and at the central region are substantially the same.

* * * * *

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 1

Line 40, "portio" should read --portion--;
Line 48, "thichness" should read --thickness--;
Line 53, "a" should read --an--;
Line 55, "phenomenon," should read --phenomenon--;
Line 56, "promotionned" should read --proportional--; and
Line 63, "corresponging" should read --corresponding--.

COLUMN 2

Line 46, "a" should read --an--.

COLUMN 3

Line 1, "a" should read --an--;
Line 8, "tranfered" should read --transferred--;
Line 56, "safty" should read --safety--; and
Line 66, "maintainig" should read --maintaining--.

COLUMN 4

Line 9, "evaporationned" should read --evaporated--;
Line 14, "tioneed" should read --ted--;
Line 17, "alccohol," should read --alcohol--;
Line 30, "matrial," should read --material--;
Line 32, "mat rials" should read --materials--; and
Line 65, "thichness" should read --thickness--.

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 5

Line 2, "material." should read --materials--;
Line 9, "metane" should read --methane--;
Line 34, "is occurred" should read --occurs--;
Line 40, "presed" should read --pressed--;
Line 59, "is deteriored." should read --deteriorates--; and
Line 60, "depositted" should read --deposited--.

COLUMN 6

Line 3, "is" should be deleted;
Line 4, "occurred" should read --occurs--; and
Line 20, "portio" should read --portion--.

COLUMN 7

Line 7, "the" (second occurrence) should be deleted;
Line 11, "thichness" should read --thickness--;
Line 27, "is" should be deleted;
Line 48, "whichthe" should read --which the--;
Line 53, "mixtured" should read --mixed--;
Line 60, "treatted" should read --treated--; and
Line 62, "cupper," should read --copper,-- and
"aluminium" should read --aluminum--.

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 8

Line 1, "example" should read --examples--;
Line 3, "salt, for example" should read --salt.--;
Line 17, "mixtured," should read --mixed,--;
Line 21, "largeer" should read --larger--;
Line 49, "portio" should read --portion--;
Line 58, "portio" should read --portion-- and "a" should read --and--;
Line 59, "of" (first occurrence) and "in" should be deleted;
Line 62, "linearely" should read --linearly-- and "porio" should read --portion--; and

COLUMN 9

Line 4, "preflyjj" should read --preferably--;
Line 6, "preflyjj" should read --preferably--;
Line 7, "preferrable" should read --preferable--;
Line 16, "a adhessive" should read --an adhesive--;
Line 32, "selfemulsifiable" should read --self-emulsifiable--;
Line 37, "ize" should be deleted; and
Line 44, "extrusionmolding" should --extension molding--.

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 10

Line 9, "divided" should read --divided into--;
Line 16, "to," should read --to--;
Line 38, after "contacted", insert --to-- and "a AC" should read --an AC--; and
Line 59, "A amount" should read --An amount--.

COLUMN 11

Line 9, "were" should read --was--;
Line 10, "A amount" should read --An amount--;
Line 22, "image" should read --images--;
Line 37, "selfemulsifiable" should read --self-emulsifiable--; and
Line 41, "selfemulsifiable" should read --self-emulsifiable--.

COLUMN 12

Line 17, "were" should read --was--;
Line 24, "were" should read --was--; and
Line 52, "Eembodiment 3" should read --Embodiment 3--.

COLUMN 13

Line 2, "a inner" should read --an inner--.

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 14

Line 1, "checked" should read --checked,--;
Line 28, "a" should read --an--; and
Line 53, "Ohm" should read --Ohm,--.

COLUMN 15

Line 24, "nots" should read --not--.

COLUMN 16

Line 18, "the paint" should read --paint--;
Line 19, "a different the resistances" should read --different resistances--;
Line 26, "a different the resistances" should read --different resistances--; and
Line 62, "oft" should read --of the--.

COLUMN 17

Line 8, "the material" should read --of different resistances--;
Line 14, "a close" should read --close--; and
Line 57, "No SHO-63149669" should read --No. SHO 63-149669--.

COLUMN 18

Line 14, "Ohm" should read --Ohm,--.

UNITED STATES PATENT AND TRADEMARK OFFICE

CERTIFICATE OF CORRECTION

PATENT NO. : 5,576,805

DATED : November 19, 1996

INVENTORS : Yuzi Ishihara, et al.

It is certified that error appears in the above-identified patent and that said Letters Patent is hereby corrected as shown below:

COLUMN 19

Line 33, change "4" to --14--; and
Line 37, before "away", insert --further--.

COLUMN 20

Line 8, "is" should read --are--; and
Line 23, before "away", insert --further--.

COLUMN 21

Line 1, before "away", insert --further--; and
Line 13, "is" should read --are--.

COLUMN 22

Line 39, "is" should read --are--.

Signed and Sealed this

Fifth Day of August, 1997

Bruce Lehman

*Attest:*

BRUCE LEHMAN

*Attesting Officer*

*Commissioner of Patents and Trademarks*